US006574982B1

(12) United States Patent
Wiseman et al.

(10) Patent No.: US 6,574,982 B1
(45) Date of Patent: Jun. 10, 2003

(54) ICEMAKER FILL TUBE ASSEMBLY

(75) Inventors: Joshua Stephen Wiseman, Elizabethtown, KY (US); Stephen Bernard Froelicher, Shepherdsville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/999,077

(22) Filed: Nov. 30, 2001

(51) Int. Cl.[7] ..... F25C 1/00

(52) U.S. Cl. ..... 62/347; 138/33

(58) Field of Search ..... 62/74, 347; 137/341; 138/33; 285/132.1, 205, 285.1; 219/528, 549, 535; 239/2.2, 14.2, 597

(56) References Cited

U.S. PATENT DOCUMENTS

| | | | | | |
|---|---|---|---|---|---|
| 36,592 | A | * | 9/1862 | Gibel et al. | 42/78 |
| 3,866,434 | A | * | 2/1975 | Pugh et al. | 62/340 |
| 3,921,414 | A | * | 11/1975 | Bright | 62/188 |
| 4,003,214 | A | | 1/1977 | Schumacher | |
| 4,020,644 | A | | 5/1977 | True, Jr. et al. | |
| 4,175,402 | A | * | 11/1979 | Hile | 62/263 |
| 4,191,025 | A | | 3/1980 | Webb | |
| 4,265,089 | A | | 5/1981 | Webb | |
| 4,268,947 | A | * | 5/1981 | Hile | 29/451 |
| 4,333,588 | A | | 6/1982 | Schreck et al. | |
| 4,413,966 | A | * | 11/1983 | Mills et al. | 264/225 |
| 4,510,974 | A | * | 4/1985 | Natori et al. | 138/124 |
| 4,617,012 | A | * | 10/1986 | Vaillancourt | 285/12 |
| 4,619,380 | A | | 10/1986 | Brooks | |
| 4,627,556 | A | | 12/1986 | Brooks | |
| 4,649,718 | A | * | 3/1987 | Linstromberg et al. | 62/340 |
| 4,762,343 | A | * | 8/1988 | Hirohata | 285/140.1 |
| 5,238,299 | A | | 8/1993 | McKinney | |
| 5,390,961 | A | * | 2/1995 | Guthrie | 138/33 |
| 5,408,844 | A | | 4/1995 | Stokes | |
| 5,425,248 | A | | 6/1995 | Trantina | |
| 5,933,574 | A | * | 8/1999 | Avansino | 392/468 |
| 6,082,780 | A | * | 7/2000 | Rowley et al. | 264/271.1 |
| 6,311,503 | B1 | | 11/2001 | Shapiro et al. | |
| 6,314,745 | B1 | | 11/2001 | Janke et al. | |

FOREIGN PATENT DOCUMENTS

| | | | | |
|---|---|---|---|---|
| JP | 356103612 A | * | 8/1981 | B60H/3/04 |
| JP | 411070859 A | * | 3/1999 | B60S/1/50 |

* cited by examiner

*Primary Examiner*—William E. Tapolcai
*Assistant Examiner*—Mohammad M. Ali
(74) *Attorney, Agent, or Firm*—H. Neil Houser, Esq.; Armstrong Teasdale LLP

(57) ABSTRACT

In one aspect, a fill tube assembly for supplying water to an icemaker is described. In one embodiment, the assembly comprises a grommet comprising and inlet and an outlet, and a fill tube configured for coupling to the grommet outlet. The fill tube comprises a slot extending from one end thereof. In another embodiment, the assembly comprises tape at least partially wrapped around a portion of the fill tube for facilitating heating at least the fill tube portion.

12 Claims, 4 Drawing Sheets

ICEMAKER FILL TUBE ASSEMBLY

BACKGROUND OF THE INVENTION

This invention relates generally to refrigerators/freezers and more particularly, to icemakers.

Refrigerators and freezers typically include an icemaker. The icemaker receives water for ice production from a water valve typically mounted to the exterior of the refrigerator or freezer case. The water valve typically is coupled to a fill tube via polyethylene tubing. Water is dispensed from the fill tube into a tray in which ice cubes are formed. Specifically, the fill tube transports water from the polyethylene tubing to the icemaker located inside the freezer. The fill tube typically is either foamed in place or extends through an opening in the case.

Water in the fill tube is subject to freezing, i.e., the fill tube is exposed to the cold air in the freezer. Several conditions can cause water in the fill tube to freeze. For example, a leaking or weeping water valve, freezing/thawing of natural forming frost, or frozen water droplets can cause fill tube freezing.

If water in the fill tube freezes, then water cannot be delivered to the icemaker. That is, if the fill tube freezes, no ice is made since water cannot be delivered to the icemaker. Additionally, if the fill tube freezes, then water pressure between the water valve and an ice plug in the fill tube can increase. A water leak can result from such increased pressure, and water may leak into the freezer or outside the case and accumulate or seep through the floor.

BRIEF SUMMARY OF THE INVENTION

In one aspect, a fill tube assembly for supplying water to an icemaker is provided. In one embodiment, the assembly comprises a grommet comprising and an inlet and an outlet, and a fill tube configured for coupling to the grommet outlet. The fill tube comprises a slot extending from one end thereof. In another embodiment, the assembly comprises tape at least partially wrapped around a portion of the fill tube for facilitating heating at least the fill tube portion.

In another aspect, a fill tube assembly comprising an insulator and a grommet for at least partially fitting within the insulator is provided. The grommet comprises an inlet and an outlet. The assembly further comprises a plate comprising a boss, and the grommet outlet extends at least partially through the boss. A fill tube has one end in engagement with the boss.

In another aspect, a freezer is provided. The freezer comprises an icemaker and a fill tube assembly. The fill tube assembly comprises a grommet comprising an inlet and an outlet. The assembly further comprises a fill tube coupled to the grommet outlet. The fill tube assembly comprises at least one ice formation prevention component. In one embodiment, the ice formation prevention component comprises an aluminum plate. In another embodiment, the ice formation prevention component comprises at least one of a slot in the fill tube, tape at least partially wrapped around a portion of the fill tube, and a foam pad at least partially wrapped around a portion of the fill tube.

DETAILED DESCRIPTION OF THE INVENTION

Icemakers are utilized in residential, or domestic, refrigerators as well as in stand alone freezers. Although the fill tube assembly is described herein in the context of a residential refrigerator, such fill tube assembly can be utilized in connection with commercial refrigerators as well as in stand-alone icemakers, i.e., icemakers that are not part of a larger freezer compartment or refrigerator. Therefore, the fill tube assembly is not limited to use in connection with only icemakers utilized in residential refrigerators, and can be utilized in connection with icemakers in many other environments. In addition, a side-by-side type refrigerator is described below in detail. The fill tube assembly is not, however, limited to use in connection with side-by-side type refrigerators and can be used with other types of refrigerators, e.g., a top mount type refrigerator.

Figure 1:
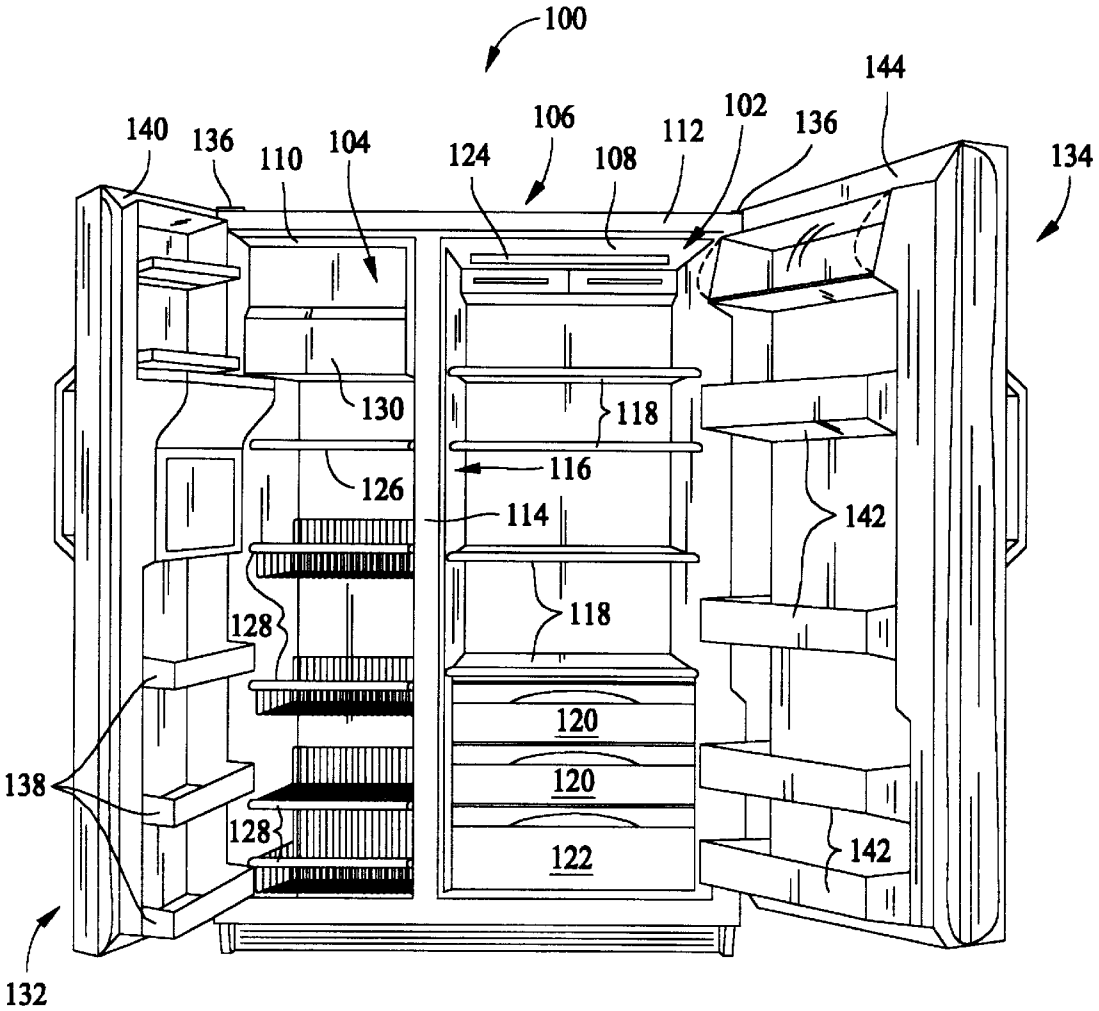
FIG. 1 illustrates a side-by-side type refrigerator.

FIG. 1 illustrates a side-by-side refrigerator 100 including a fresh food storage compartment 102 and a freezer storage compartment 104. Freezer compartment 104 and fresh food compartment 102 are arranged side-by-side. A side-by-side refrigerator such as refrigerator use is commercially available from General Electric Company, Appliance Park, Louisville, Ky. 40225.

Refrigerator 100 includes an outer case 106 and inner liners 108 and 110. A space between case 106 and liners 108 and 110, and between liners 108 and 110, is filled with foamed-in-place insulation. Outer case 106 normally is formed by folding a sheet of a suitable material, such as pre-painted steel, into an inverted U-shape to form top and side walls of case. A bottom wall of case 106 normally is formed separately and attached to the case side walls and to a bottom frame that provides support for refrigerator 100. Inner liners 108 and 110 are molded from a suitable plastic material to form freezer compartment 104 and fresh food compartment 102, respectively. Alternatively, liners 108, 110 may be formed by bending and welding a sheet of a suitable metal, such as steel. The illustrative embodiment includes two separate liners 108, 110 as it is a relatively large capacity unit and separate liners add strength and are easier to maintain within manufacturing tolerances. In smaller refrigerators, a single liner is formed and a mullion spans between opposite sides of the liner to divide it into a freezer compartment and a fresh food compartment.

A breaker strip 112 extends between a case front flange and outer front edges of liners. Breaker strip 112 is formed from a suitable resilient material, such as an extruded acrylo-butadiene-syrene based material (commonly referred to as ABS).

The insulation in the space between liners 108, 110 is covered by another strip of suitable resilient material, which also commonly is referred to as a mullion 114. Mullion 114 also preferably is formed of an extruded ABS material. It will be understood that in a refrigerator with separate mullion dividing a unitary liner into a freezer and a fresh food compartment, a front face member of mullion corresponds to mullion 114. Breaker strip 112 and mullion 114 form a front face, and extend completely around inner peripheral edges of case 106 and vertically between liners 108, 110. Mullion 114, insulation between compartments, and a spaced wall of liners separating compartments, sometimes are collectively referred to herein as a center mullion wall 116.

Shelves 118 and slide-out drawers 120 and 122 normally are provided in fresh food compartment 102 to support items being stored therein. A control interface 124 is mounted in an upper region of fresh food storage compartment 102. A shelf 126 and wire baskets 128 are also provided in freezer compartment 104. In addition, an icemaker 130 is provided in freezer compartment 104.

A freezer door 132 and a fresh food door 134 close access openings to fresh food and freezer compartments 102, 104, respectively. Each door 132, 134 is mounted by a top hinge 136 and a bottom hinge (not shown) to rotate about its outer vertical edge between an open position, as shown in FIG. 1, and a closed position (not shown) closing the associated storage compartment. Freezer door 132 includes a plurality of storage shelves 138 and a sealing gasket 140, and fresh food door 134 also includes a plurality of storage shelves 142 and a sealing gasket 144.

Regarding icemaker 130, icemaker 130 receives water for ice production from a water valve typically mounted to the exterior of the refrigerator. In one embodiment, the water valve is coupled to a fill tube via polyethylene tubing. Water is dispensed from the fill tube into a tray in which ice cubes are formed. Specifically, the fill tube transports water from the polyethylene tubing to icemaker 130. As explained above, water in the fill tube is subject to freezing, i.e., the fill tube is exposed to the cold air in the freezer, and ice plugs can form in the fill tube. The ice plug prevents water from flowing to icemaker 130 and also can result in water leaks due to increased water pressure in the polyethylene tubing.

Figure 2:
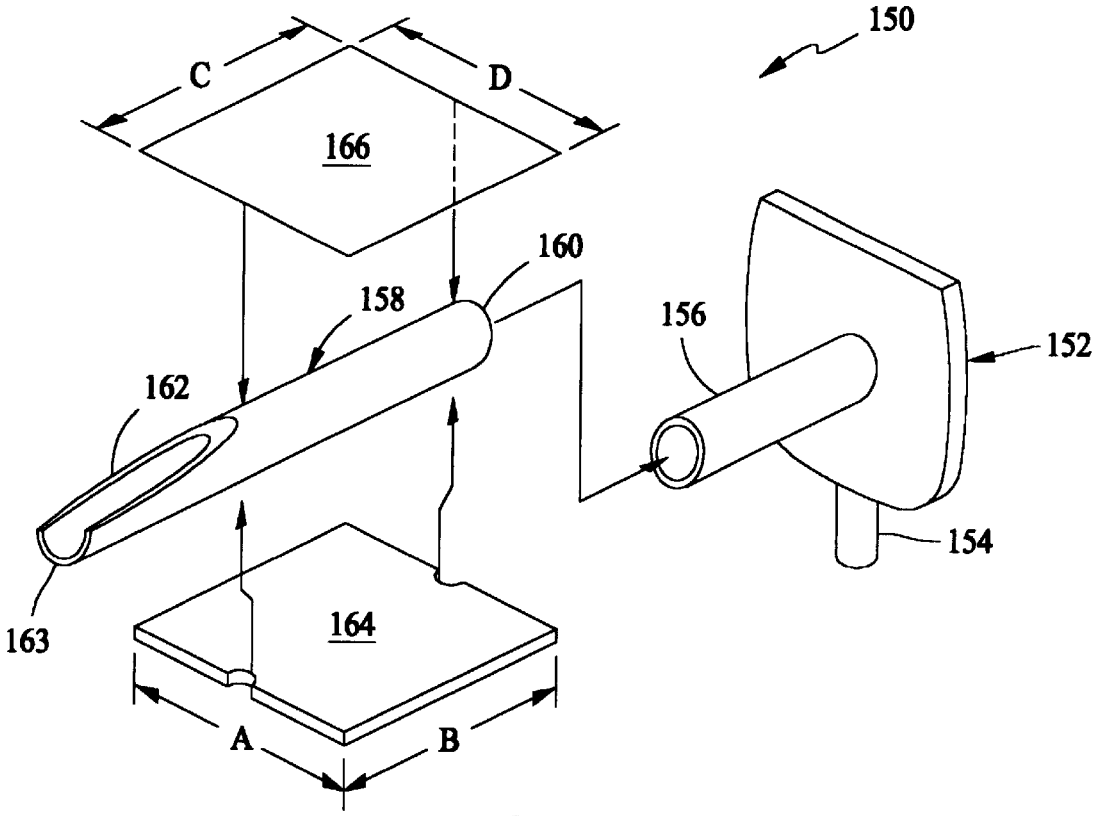
FIG. 2 is an exploded view of one embodiment of a fill tube assembly.
Figure 3:
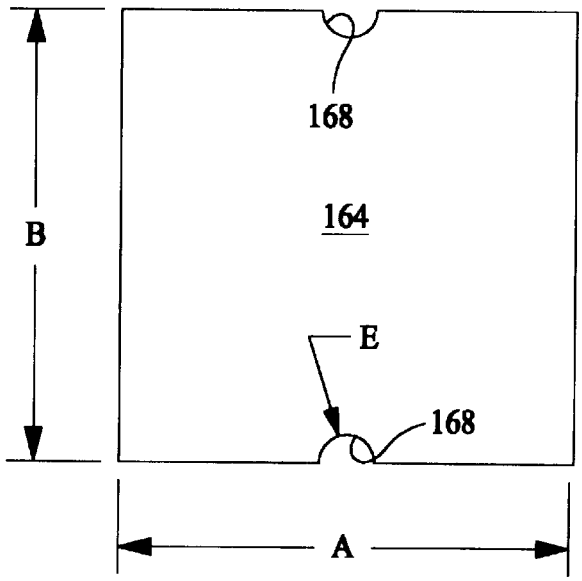
FIG. 3 is a top plan view of the foam pad shown in FIG. 2.
Figure 4:
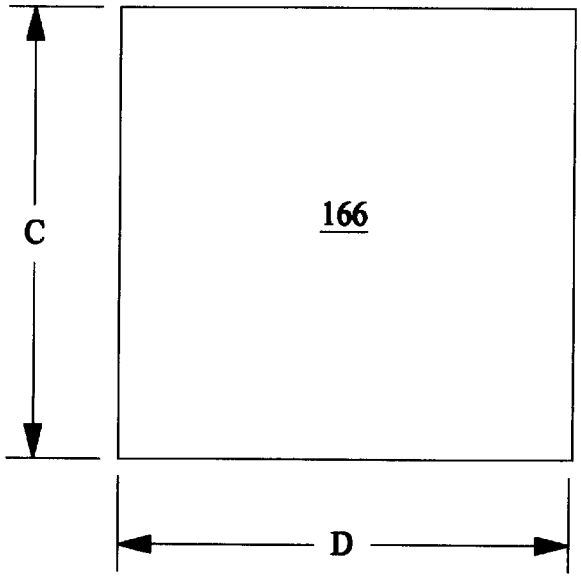
FIG. 4 is a top plan view of the aluminum tape shown in FIG. 2.
Figure 5:
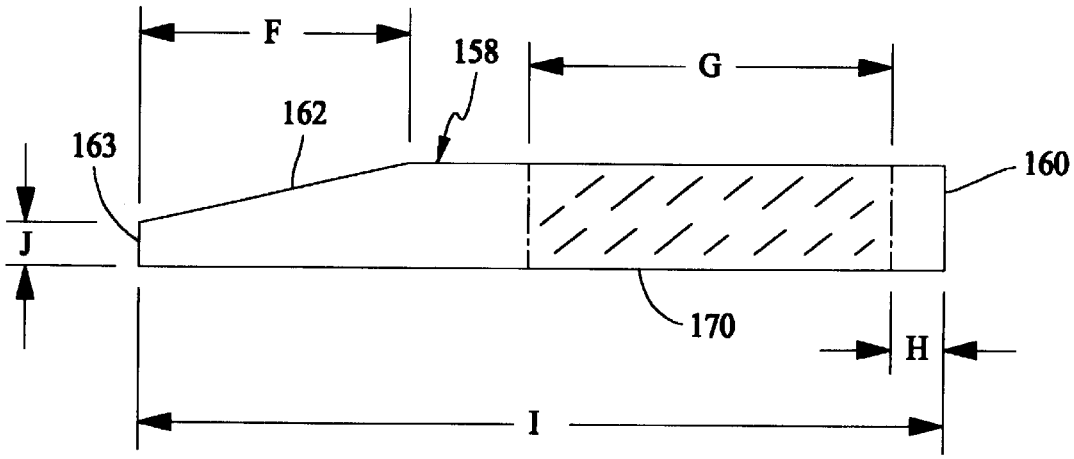
FIG. 5 is a side view of the tube shown in FIG. 2.

FIG. 2 is an exploded perspective view of one embodiment of a fill tube assembly 150. FIGS. 3–5 illustrate components of fill tube assembly 150. Referring specifically to FIG. 2, assembly 150 includes a grommet 152 which includes an inlet 154 and an outlet 156. Inlet 154 is configured to couple to a polyethylene tube (not shown) which extends from a water valve (not shown) to inlet 154. In one embodiment, one end of the polyethylene tube slides over inlet 154 and forms a tight fit with inlet 154. Assembly 150 also includes a fill tube 158 configured to couple to grommet outlet 156. In one embodiment, an end 160 of tube 158 slides over outlet 156 and forms a tight fit with outlet 156. Fill tube 158 includes a tapered slot 162 starting at an end 163 opposite end 160, and slot 162 facilitates preventing an ice slug binding in tube 158. Specifically, slot 162 shortens the length of tube 158 in which an ice slug can form, i.e., rather than the entire length of tube 158, an ice slug can only form in the non-slotted portion of tube 158. In addition, slot 162 similarly shortens the length of tube 158 in which frost can form, i.e., the frosting length is reduced from the full length of tube 158 to the non-slotted portion of tube 158. Slot 162 also facilitates preventing mechanical binding of an ice slug during a defrost operation.

Assembly 150 further includes a foam pad 164 and aluminum tape 166. Generally, aluminum tape 166 is first wrapped around a portion of tube 158, and then foam pad 164 is wrapped around tape 166.

FIG. 3 is a top plan view of foam pad 164 and FIG. 4 is a top plan view of aluminum tape 166. As shown in FIG. 3, foam pad 164 includes opposing cut-out sections 168.

Figure 6:
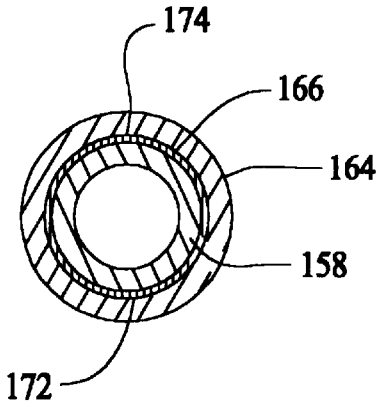
FIG. 6 is an end view of the fill tube with the foam pad and aluminum tape wrapped thereon.

FIG. 5 is a side view and FIG. 6 is an end view of tube 158. A portion 170 of tube 158 is configured to have pad 164 and tape 166 wrapped therearound, as described below in more detail. In one embodiment, tube portion 170 is located in the foamed wall of the refrigerator. Aluminum tape 166 facilitates warming portion 170 of tube such that the tube walls exceed 32° F. during the refrigerator compressor off cycle. In one specific embodiment, aluminum tape 166 maintains the fill tube temperature in the area of tape 166 above freezing in an off cycle and during a defrost operation with a 70° F. termination temperature being utilized.

Closed cell foam pad 164 is wrapped around portion 170 of tube that is placed through the cored foam hole. Pad 164 facilitates preventing cold air from surrounding tube 158 and facilitates preventing freezing of water in tube 158. That is, pad 164 provides friction holding force between fill tube 158 and the refrigerator case insulation. Consequently, fill tube 158 is less likely to shoot out into the icemaker fill cup during a fill operation and such friction forces also facilitate utilizing higher water pressure to clear an ice plug from fill tube.

Slot 162, foam pad 164, and aluminum tape 166 are separately and collectively sometimes referred to herein as ice formation prevention components since such components facilitate preventing the formation of ice in fill tube 158. Example dimensions for the components of fill tube assembly 150 are set forth below. Such dimensions are in inches unless otherwise indicated. Of course, in other embodiments, other dimensions can be employed and the dimensions below are by way of example only.

A=2.25
B=2.50
C=2.00
D=2.00
E=0.25ø
F=1.50
G=2.00
H=0.100+/−0.100(0.200 max)
I=4.50
J=0.25

Referring to FIG. 6, tape 166 is wrapped with a seam 172 down. Pad 164 is wrapped with a seam 174 up. Staggering seams 172 and 174 facilitates preventing ice plugs in tube 158.

In operation, water is supplied to tube 158 via grommet 152, and water flows from tube 158 into icemaker 130. Tapered slot 162 facilitates preventing frost from forming on tube 158, and specifically facilitates preventing frost from forming thereon, i.e., on slot 162 itself. Aluminum tape 166 facilitates warming portion 170 of tube 158 that is located in the refrigerator wall, and foam pad 164 facilitates preventing cold air from surrounding tube 158 to prevent freezing.

Figure 7:
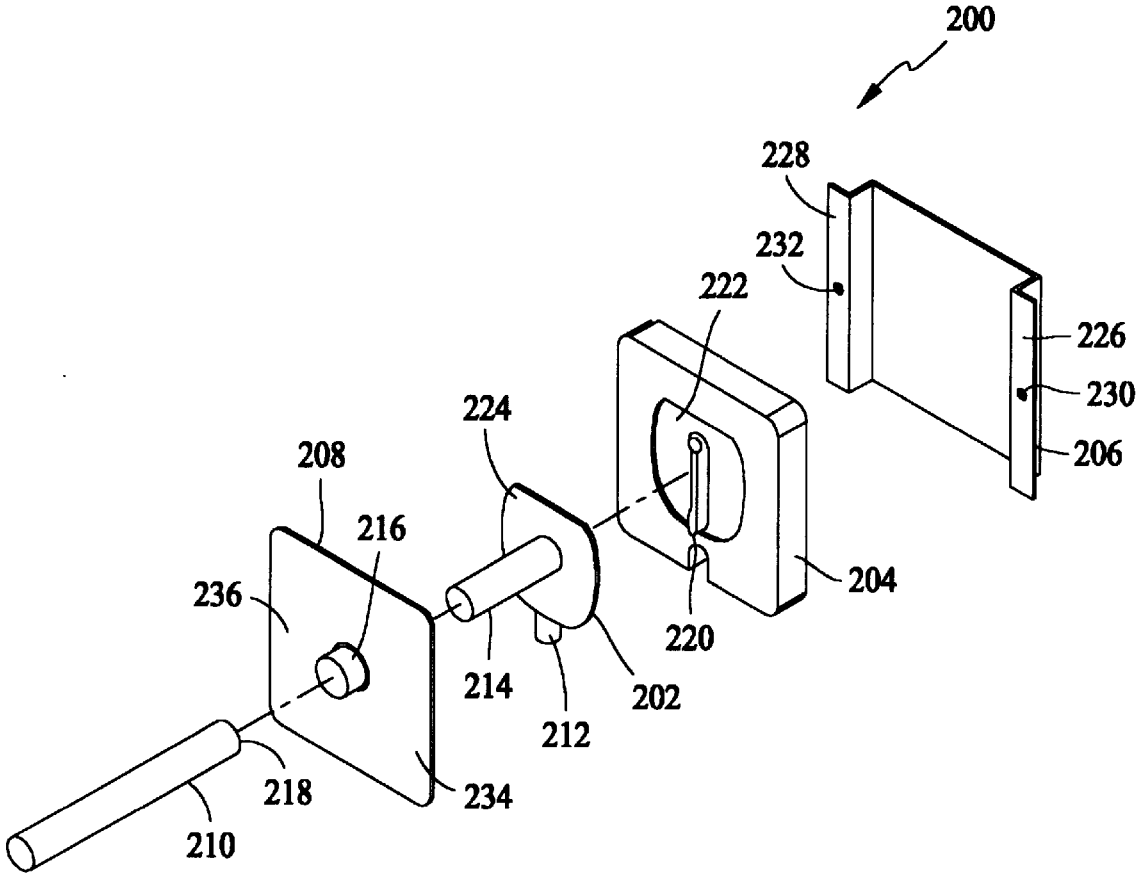
FIG. 7 is an exploded view of another embodiment of a fill tube assembly.

FIG. 7 is an exploded view of another embodiment of a fill tube assembly 200. Assembly 200 includes a plastic grommet 202 for conveying water. At least a portion of grommet 202 fits within an insulator 204 that facilitates preventing sweat that could subsequently freeze. A cover 206 facilitates preventing damage. An aluminum plate 208 is in intimate contact with the back of the refrigerator case and transfers heat to aluminum fill tube 210, thus facilitating preventing freeze-up.

More particularly, grommet 202 includes an inlet 212 and an outlet 214. Inlet 212 is configured to couple to a polyethylene tube (not shown) which extends from a water valve (not shown) to inlet 212. In one embodiment, one end of the polyethylene tube slides over inlet 212 and forms a tight fit with inlet 212. Grommet outlet 214 slides into an opening and through boss 216 of plate 208. An end 218 of tube 210 slides over outlet 214 and into engagement with boss 216.

Insulator 204 includes a cut-out portion 220, and outlet 214 of grommet 202 fits within a grommet plate 224 of grommet 202. Insulator 204 facilitates preventing the formation of sweat on grommet 202 and fill tube 210.

Cover 206 includes flanges 226 and 228 having openings 230 and 232 therein that align with openings 234 and 236 in plate 208. Cover 206 is secured to plate 208 by screws (not shown) that extend through aligned openings 230, 234 and 232, 236. Cover 206 facilitates preventing damage to grommet 202 and insulator 204. Plate 208 is an ice formation prevention component in that plate 208, by being in intimate contact with the back of the refrigerator, is heated and such heat energy is transferred by plate 208 via boss 216 to tube 210. Such heat transfer facilitates preventing ice plugs from forming in tube 210.

In addition to the fill tube assembly embodiments described herein, operation of the refrigerator defrost cycle can be adjusted so that the fill tube receives adequate energy to defrost any ice build up that might occur on the fill tube. More particularly, a refrigerator typically includes a refrigeration circuit including a compressor, an evaporator, and a condenser connected in series. An evaporator fan is provided to blow air over the evaporator, and a condenser fan is provided to blow air over the condenser. Such refrigerators also typically include defrost heaters coupled to a defrost control for controlling defrost operations. Adjustable parameters include, for example, the defrost termination temperature (i.e., the temperature at which the defrost heaters are de-energized by the defrost control), amount of time the defrost heaters are on, the amount of system dwell time, and the amount of evaporator dwell time. Dwell time generally is the time period after one cycle has been terminated and before another cycle is initiated. For example, defrost dwell time is the time period after defrost heat is terminated and before the compressor is allowed to turn back on, i.e., before a cold control re-energizes the compressor. Increasing the defrost termination temperature raises the peak temperature of the fill tube. Increased evaporator fan delay allows more time at a given temperature of the fill tube.

While the invention has been described in terms of various specific embodiments, those skilled in the art will recognize that the invention can be practiced with modification within the spirit and scope of the claims.

What is claimed is:

1. A fill tube assembly for supplying water to an icemaker, said assembly comprising:

a grommet comprising an inlet and an outlet; and a substantially straight fill tube configured for coupling to said grommet outlet, said fill tube comprising a slot extending from one end thereof.

2. A fill tube assembly according to claim 1 wherein said slot is tapered.

3. A fill tube assembly according to claim 1 further comprising aluminum tape at least partially wrapped around a portion of said fill tube.

4. A fill tube assembly according to claim 3 further comprising a foam pad at least partially wrapped around said fill tube portion.

5. A fill tube assembly for supplying water to an icemaker, the tube at least partially located in a refrigerator wall, said assembly comprising:

a grommet comprising an inlet and an outlet;

a fill tube configured for coupling to said grommet outlet; and a thermal tape at least partially wrapped around a portion of said fill tube located in the refrigerator wall for facilitating heating at least said portion of said fill tube.

6. A fill tube assembly according to claim 5 wherein said tape comprises aluminum.

7. A fill tube assembly according to claim 5 further comprising a foam pad at least partially wrapped around said fill tube portion and over said tape.

8. A fill tube assembly according to claim 5 wherein said tube comprises a tapered slot extending from one end thereof.

9. A fill tube assembly comprising:

an insulator;

a grommet for at least partially fitting within said insulator, said grommet comprising an inlet and an outlet;

a plate comprising a boss, said grommet outlet extending at least partially through said boss; and a fill tube having one end in engagement with said boss.

10. A fill tube assembly according to claim 9 further comprising a cover, said cover configured for being secured to said plate.

11. A fill tube assembly according to claim 9 wherein said plate and said fill tube comprise aluminum.

12. A fill tube assembly according to claim 9 wherein said grommet comprises plastic.

* * * * *